US005848915A

United States Patent [19]

Canizales

[11] Patent Number: 5,848,915

[45] Date of Patent: Dec. 15, 1998

[54] OFFSET POWER STRIP

[76] Inventor: Mark J Canizales, 105o Franklin No. 100, San Francisco, Calif. 94109-6830

[21] Appl. No.: 756,116

[22] Filed: Nov. 25, 1996

[51] Int. Cl.[6] ..... H01R 33/92

[52] U.S. Cl. ..... 439/650; 439/954; D13/142

[58] Field of Search ..... 439/650, 651, 439/652, 653, 954, 535; D13/137, 142, 143, 146, 147, 152

[56] References Cited

U.S. PATENT DOCUMENTS 3,049,688 8/1962 Sinopoli ..... 439/651

5,605,466 2/1997 Devlin et al. ..... 439/144

5,658,158 8/1997 Milan ..... 439/652

*Primary Examiner*—Neil Abrams

*Assistant Examiner*—Brian J. Biggi

*Attorney, Agent, or Firm*—Michael I. Kroll

[57] ABSTRACT

An offset power strip (22) comprising a zigzag housing (24). A plurality of socket members (26) are placed in a staggered arrangement into a front face (28) of the zigzag housing (24). A facility (30) is for connecting all of the socket members (26) to a power supply, so that all of the socket members (26) can be used to accommodate transformer plugs (20).

10 Claims, 5 Drawing Sheets

OFFSET POWER STRIP

BACKGROUND OF THE INVENTION

1. Field of the Invention

The instant invention relates generally to multiple receptacle devices and more specifically it relates to an offset power strip. The offset power strip has a zigzag housing with a plurality of staggered socket members therein, so that all of the socket members can accommodate transformer plugs.

2. Description of the Prior Art

Numerous multiple receptacle devices have been provided in prior art. For example, U.S. Pat. Nos. 4,583,799 to Wiley; 5,350,310 to Chen and 5,236,374 to Leonard et al. all are illustrative of such prior art. While these units may be suitable for the particular purpose to which they address, they would not be as suitable for the purposes of the present invention as heretofore described.

WILEY, ROY O.

MULTIPLE OUTLET RECEPTACLE

U.S. Pat. No. 4,583,799

A multiple outlet receptacle, such as with four outlets, is provided that has a housing that accommodates the internal contact elements which are respectively supported on conductive plates within the housing that include two plates fitting within the same plane and having the contact elements extending forwardly therefrom to plug receiving apertures in the front face of the housing. The internal contact elements and the front face apertures are configured so that angle plugs may be placed in each of the four outlets without interference with each other or their line cords and may extend in each of four orthogonal directions to fixtures with which they are connected. The housing can be of molded insulating material integrally formed with a mounting flange.

LEONARD, THOMAS R.

MUNSON, EDWARD J.

EXTENSION CORD WITH MULTIPLE RECEPTACLES

U.S. Pat. No. 5,236,374

An extension cord with multiple receptacles having an electric wire with a first end, a second end, and a male plug coupled to the first end and a method for forming same. A fuse is coupled to the wire. Multiple receptacle blocks are coupled to the wire at spaced intervals along the wire. One of the receptacle blocks is coupled to the second end of the wire. Each of the receptacle blocks has several pairs of slots for receiving male plugs of items to be powered by the extension cord.

CHEN, KEN-CHING

SOCKET TERMINAL

U.S. Pat. No. 5,350,310

A socket terminal including a shell, a pair of electrodes linked to the main power supply and at least one pair of conductive strips for connecting a pair of leads of a device to the pair of electrodes. The pair of conductive strips in a casing rotatable between a first position and a second position relative to the pair of electrodes. The pair of conductive strips contacts the pair of electrodes when the casing is in the first position. In a first embodiment, each electrode is a linear strip. Thus, the conductive strips disengage from the electrodes when the casing is in the second position. In a second embodiment, each electrode consists of a linear strip and at least one ear transversely projecting from the linear strip. Thus, the pair of conductive strips engages with the pair of linear strips of the electrodes when the casing is in the first position. The pair of conductive strips engages with the pair of ears when the casing is in the second position.

SUMMARY OF THE INVENTION

A primary object of the present invention is to provide an offset power strip that will overcome the shortcomings of the prior art devices.

Another object is to provide an offset power strip with a zigzag housing with a plurality of staggered socket members therein, so that all of the socket members can be used to accommodate transformer plugs.

An additional object is to provide an offset power strip that contains a built-in circuit breaker with a rest button for safety, to protect all of the transformer plugs plugged into the staggered socket members.

A further object is to provide an offset power strip that is simple and easy to use.

A still further object is to provide an offset power strip that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 3:
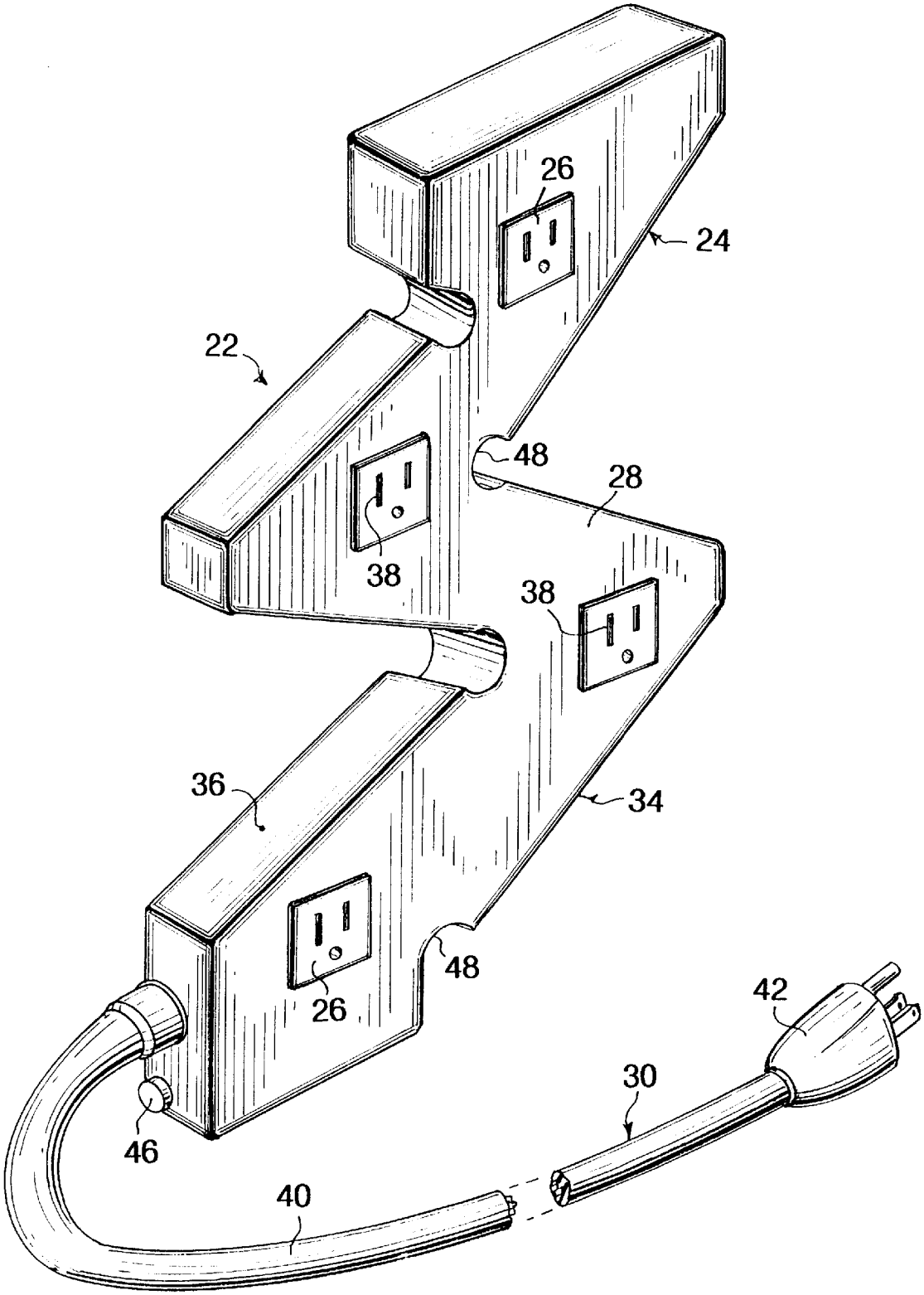
FIG. 3 is a perspective view of the first embodiment taken in the direction of arrow 3 in FIG. 2.
Figure 3A:
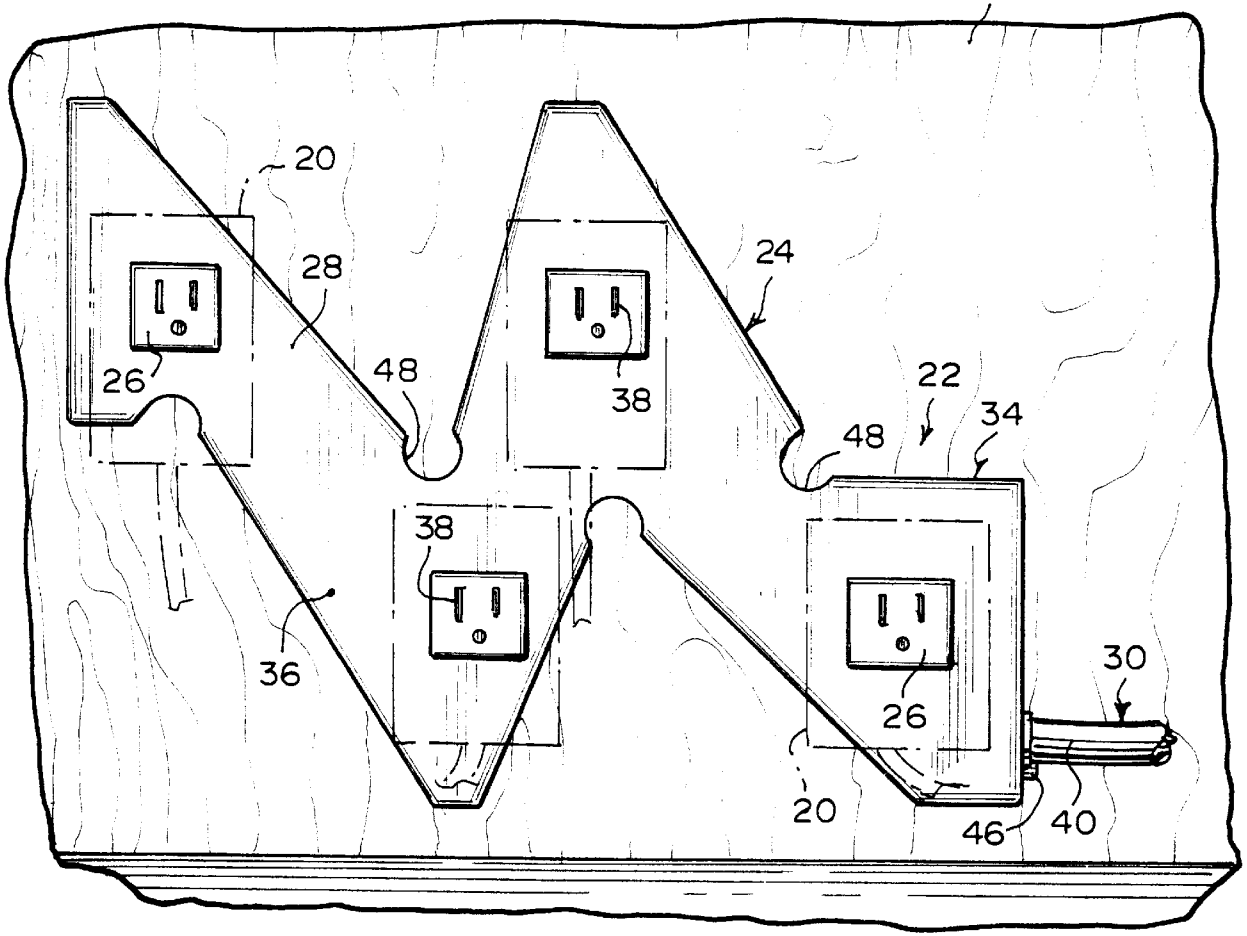

FIG. 3*a* is a front elevational view of a second embodiment of the instant invention.

Figure 4:
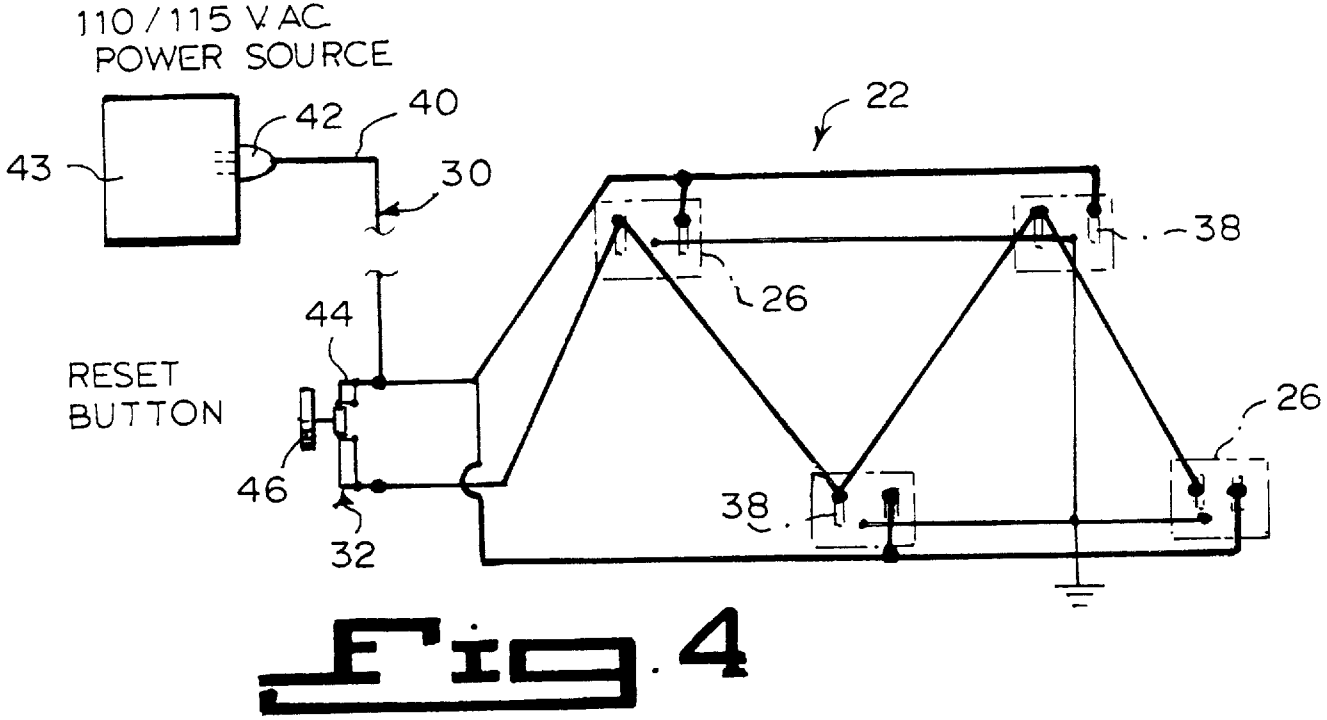

FIG. 4 is a diagrammatic view of the electrical circuitry in the first and second embodiments.

Similar reference characters denote corresponding features consistently throughout the attached drawings.

DETAILED DESCRIPTION OF THE PREFERRED EMBODIMENTS

Figure 1:
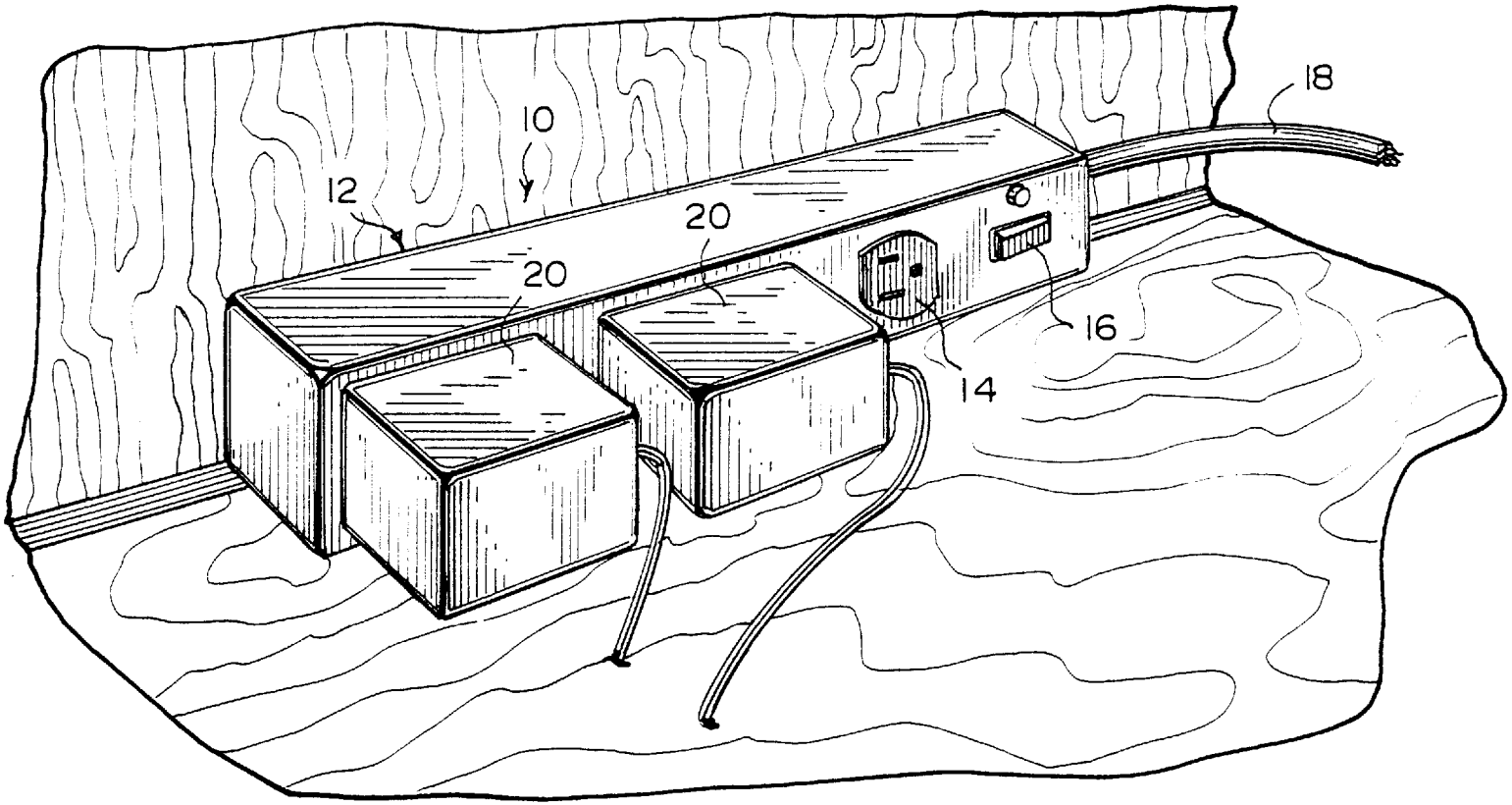
Fig. 1 (PRIOR ART)
FIG. 1 is a perspective view of the prior art in use.

Turning now descriptively to the drawings, in which similar reference characters denote similar elements throughout the several views, FIG. 1 illustrates the prior art. A conventional power strip 10 is shown consisting of a rectangular casing 12 with a plurality of side by side outlets 14 therein. An on/off switch 16 is on the rectangular casing 12 and a power cord 18 extends from one side of the rectangular casing 12. The conventional power strip 10 can accommodate only a few transformer plugs 20 thereon.

Figure 2:
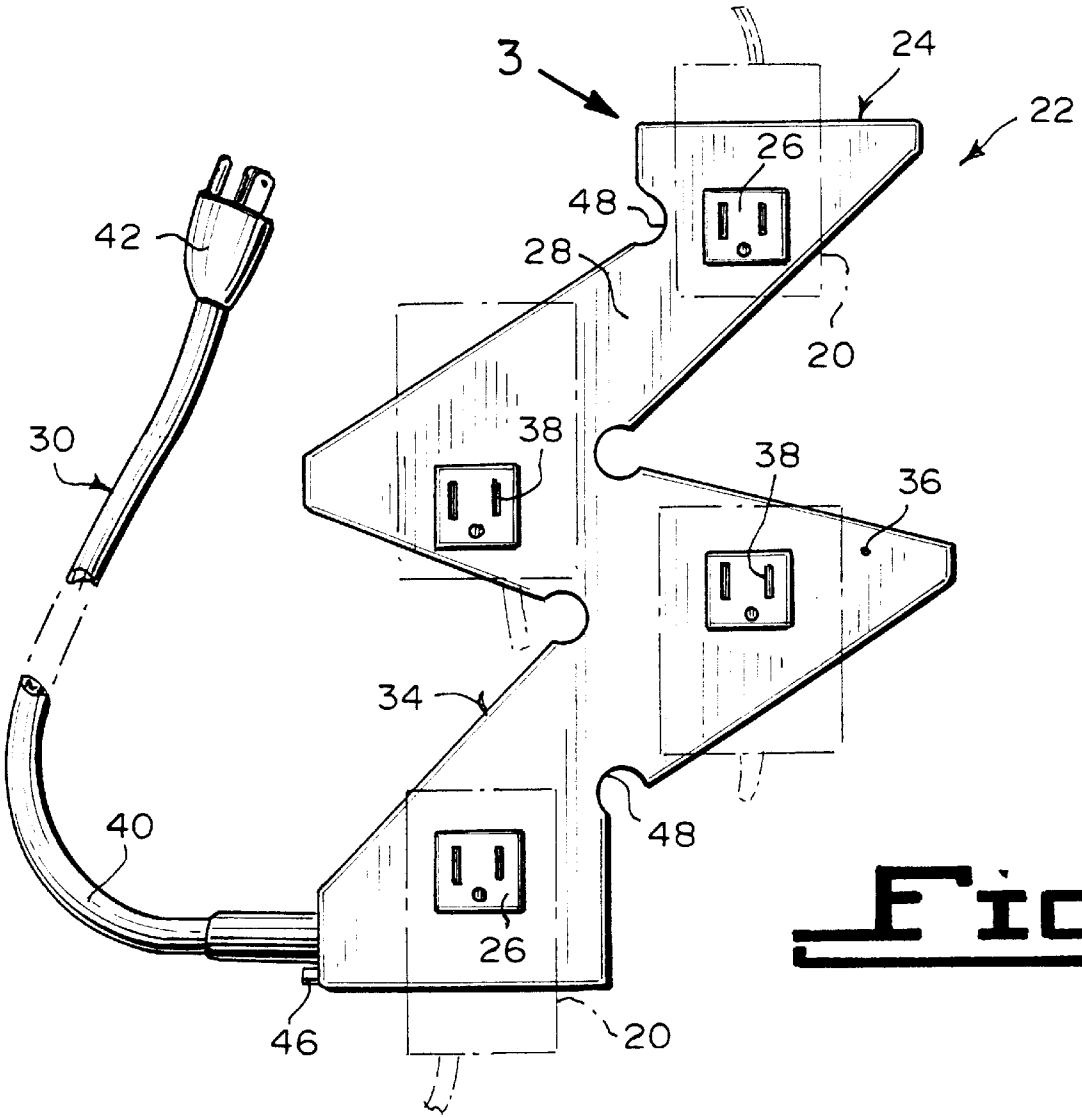
FIG. 2 is a front elevational view of a first embodiment of the instant invention with parts broken away and the transformer plugs in phantom.

FIGS. 2 to 4 illustrate the instant invention being an offset power strip 22, comprising a zigzag housing 24. A plurality of socket members 26 are placed in a staggered arrangement into a front face 28 of the zigzag housing 24. A facility 30 is for connecting all of the socket members 26 to a power supply, so that all of the socket members 26 can be used to accommodate transformer plugs 20.

The offset power strip 22, shown in FIG. 4, further includes a component 32 for opening a circuit to the socket members 26, when a current exceeds a predetermined value. The zigzag housing 24 is a molded body 34 made out of an insulating material 36. Each socket member 26 has three slots 38, to receive three prongs from one transformer plug 20.

The connecting facility 30 is a power cord 40 electrically coupled to all of the socket members 26. A plug 42 is electrically coupled to a free end of the power cord 40. The plug 42 can engage with an electrical receptacle 42, to receive the power supply therefrom.

The circuit opening component 32 is a circuit breaker 44. The circuit breaker 44 is located in the zigzag housing 24. The circuit breaker 44 is electrically coupled between the connecting facility 30 and all of the socket members 26. The circuit breaker 44 includes a reset button 46. The circuit breaker 44 can be manually closed by the reset button 46 after the circuit breaker 44 opens the circuit to the socket members 26, when the current exceeds the predetermined value.

In FIGS. 2 and 3, the socket members 26 are vertically oriented within the zigzag housing 24. The zigzag housing 24 will extend generally in a vertical position with respect to all of the transformer plugs 20. In FIGS. 3*a* and 4, the socket members 26 are horizontally oriented within the zigzag housing 24. The zigzag housing 24 will extend generally in a horizontal position with respect to all of the transformer plugs 20.

The zigzag housing 24 further has a plurality of semicircular cutout areas 48. Each semicircular cutout area 48 is located at a sharp corner turn thereof, so that the zigzag housing 24 can be mounted to a vertical support surface 50 at the semicircular cutout areas 48.

OPERATION OF THE INVENTION

To use the offset power strip 22 the following steps should be taken:

1. Depress the reset button 46, so that the circuit breaker 44 will close the circuit to all of the socket members 26.
2. Insert the plug 42 on the power cord 40 into the electrical receptacle 42 to receive the power supply therefrom.
3. Mount the zigzag housing 24 via the semicircular cutout areas 48 onto the vertical support surface 50.
4. Engage all of the transformer plugs 20 into their respective socket members 26 that are in a staggered arrangement in the front face 28 of the zigzag housing 24.
5. Check out all of the transformer plugs 20 if the circuit breaker 44 opens the circuit, indicating that there is a short causing the current to exceed the predetermined value.
6. Correct the problem and depress the reset button 46 again.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An offset power strip comprising:

a) a zigzag housing having a front face in one plane said face having a perimeter of zigzag configuration;

b) a plurality of socket members all of which are staggered in said front face of said housing, said socket members forming a zigzag in and corresponding to said front face and all in said plane to accommodate transformer plugs;

c) means for connecting all of said socket members to a power supply; and d) said housing having a cutout area located in a corner where said housing bends to permit said housing to be mounted on a vertical support surface.

2. An offset power strip as recited in claim 1, further including means for opening a circuit to said socket members when a current exceeds a predetermined value.

3. An offset power strip as recited in claim 2, wherein said circuit opening means is a circuit breaker.

4. An offset power strip as recited in claim 3, wherein said circuit breaker is located in said zigzag housing.

5. An offset power strip as recited in claim 4, wherein said circuit breaker is electrically coupled between said connecting means and all of said socket members.

6. An offset power strip as recited in claim 3, wherein said circuit breaker includes a reset button, so that said circuit breaker can be manually closed by said reset button after said circuit breaker opens the circuit to said socket members when the current exceeds the predetermined value.

7. An offset power strip as recited in claim 1, wherein said zigzag housing is a molded body made out of an insulating material.

8. An offset power strip as recited in claim 1, wherein each said socket member has three slots to receive three prongs from one transformer plug.

9. An offset power strip as recited in claim 1, wherein said connecting means is a power cord electrically coupled to all of said socket members.

10. An offset power strip as recited in claim 9, wherein said connecting means further includes a plug electrically coupled to a free end of said power cord, so that said plug can engage with an electrical receptacle to receive the power supply therefrom.

* * * * *